US005610990A

United States Patent [19]

Wooderson et al.

[11] Patent Number: 5,610,990

[45] **Date of Patent: *Mar. 11, 1997**

[54] HAIR DRYER WITH INTEGRAL STEREO AUDIO SYSTEM

[75] Inventors: Blaise M. Wooderson; Lewis A. Mendelson, both of Industrial Airport, Kans.

[73] Assignee: Helen of Troy Limited, Barbados

[ * ] Notice: The term of this patent shall not extend beyond the expiration date of Pat. No. 5,531,032.

[21] Appl. No.: 395,712

[22] Filed: Feb. 28, 1995

Related U.S. Application Data

[63] Continuation-in-part of Ser. No. 361,734, Dec. 22, 1994, Pat. No. 5,531,032.

[51] Int. Cl.[6] ..... H04R 5/00

[52] U.S. Cl. ..... 381/90; 381/189; 34/90

[58] Field of Search ..... 34/99, 90, 91, 34/96–101; 181/143, 150; 381/205, 183, 188, 189, 24, 90; 455/89, 90, 351

[56] References Cited

U.S. PATENT DOCUMENTS

| | | | |
|---|---|---|---|
| 2,541,980 | 2/1951 | Antone | 381/205 |
| 3,230,320 | 1/1966 | Kerr | 381/183 |
| 3,237,713 | 3/1966 | Leslie | 379/453 |
| 4,020,284 | 4/1977 | Phillips | 381/2 |
| 4,038,759 | 8/1977 | Dyer et al. | 34/99 |
| 4,635,039 | 1/1987 | Grosswiller | 181/143 |
| 4,641,014 | 2/1987 | Bland | 455/344 |

OTHER PUBLICATIONS

Dec. 1987 Dellco catalog, p. 151.
1992–1993 Service Merchandise Jewelry and General Merchandise catalog, p. 303, Dec. 1993.
Lady Carel Salon Hair, Nov. 1994.
Lady Dazey, Nov. 1994.
Lady Dazey 1400 Hair Dryer, Nov. 1994.
Dazey Natural Wonder 1400, Nov. 1994.

*Primary Examiner*—Curtis Kuntz
*Assistant Examiner*—Vivian Chang
*Attorney, Agent, or Firm*—Baker & McKenzie

[57] ABSTRACT

A bonnet style hair dryer includes integral left and right speakers. Both rigid bonnet and soft bonnet embodiments are described. In either embodiment, each of the speakers is positioned proximate a respective ear of the user when the bonnet is placed over the user's head. Air deflectors prevent heated air form being directed onto the speakers. A stereo audio cable is connected to the speakers with the opposite end connected to a stereo audio jack positioned within the bonnet. The speakers can thus be connected, via a removable external audio cable, to any suitable audio source, including radio, television audio, stereo music source, etc. so that a user can receive audio entertainment or information while her or his hair is being dried. At the same time, should the user not desire to listen to audio programming, the external cable can be easily removed and the entire stereo audio system becomes virtually invisible from the exterior of the hair dryer.

7 Claims, 3 Drawing Sheets

HAIR DRYER WITH INTEGRAL STEREO AUDIO SYSTEM

CROSS REFERENCE TO RELATED APPLICATIONS

This application is a continuation-in-part of application Ser. No. 08/361,734 entitled HAIR DRYER WITH INTEGRAL STEREO AUDIO SYSTEM, filed Dec. 22, 1994, now U.S. Pat. No. 5,531,032.

BACKGROUND OF THE INVENTION

1. Field of the Invention

This invention is directed to a hair dryer with a rigid bonnet which is lowered over a user's head and into which heated air is blown for drying purposes. More particularly, the inventive hair dryer includes an integral stereo audio system with a pair of stereo earphones or speakers which are physically built into the rigid bonnet, with one speaker placed proximate to each ear of the user. An alternative embodiment utilizes a soft bonnet with an integral pair of stereo speakers physically included therewith. In either embodiment, an audio jack is connected to the speakers and a removable external audio cable allows the speakers to be connected to any suitable source of audio information or entertainment. In either embodiment, the speakers can also be connected, via the external audio cable, to lap top computers and video games. In both embodiments, an air deflector is placed around the speakers within the bonnet such that heated air is not blown directly onto the speakers.

2. Description of the Related Art

Hair dryers equipped with bonnets through which heated air is blown to dry a user's hair have been known for some time. This type of hair dryer is a staple of commercial hair salons since it dries hair much faster, more evenly and more thoroughly than hand held "blow dryers". Bonnet style hair dryers for home consumer use have also been available, but in recent years have largely been superseded by hand held blow dryers. One problem with bonnet style hair dryers for home use is the need for the user to remain stationary for a relatively long time period. This situation, coupled with the necessity to wear a bonnet which prevents the user from accessing audio entertainment or information such as radio, television audio, music sources, computers, lap top computers and video games with audio signals, has limited the popularity and marketability of consumer-oriented bonnet-style hair dryers.

It is clear then, that a need exists for a bonnet style hair dryer which allows a user to access audio entertainment or information while the hair dryer is in use. At the same time, such a hair dryer should be attractive, relatively simple and economical to produce and sell, should not incorporate unnecessary electronic components which are subject to failure during the life of the hair dryer, and should be selectively connectable to any suitable audio entertainment or information source.

SUMMARY OF THE INVENTION

In the practice of the present invention, a first embodiment of a bonnet style hair dryer includes a rigid bonnet with an integral stereophonic or stereo audio system with a pair of stereo speakers. One of the speakers is positioned proximate each ear of a user when the bonnet is placed over his or her head. In a second embodiment, the bonnet is flexible, but also incorporates a pair of stereo speakers therein. In both embodiments, a two conductor stereo audio cable is separately attached to each speaker and extends between the speakers and a stereophonic telephone type audio input jack. A removable external audio cable is selectively connectable between the audio input jack and any suitable audio signal source, including radio, television audio, tape player, stereo music source, compact disc player, computer, lap top computer, video game, etc. so that a user can conveniently receive stereo or monaural audio entertainment or information while his or her hair is being dried. Within the bonnets, a deflector is positioned around the speakers such that heated air is prevented from reaching the speakers.

OBJECTS AND ADVANTAGES OF THE INVENTION

The principle objects and advantages of the present invention include: to provide a bonnet style hair dryer with an integral stereo audio system; to provide such a hair dryer in which a pair of stereo speakers are integrally attached within the bonnet with each speaker positioned proximate a respective ear of a user; to provide such a hair dryer with alternative rigid bonnet and soft bonnet construction; to provide such a hair dryer in which, in either embodiment, the stereo speakers are connected to a telephone type audio jack positioned within the bonnet with an opening extending through an outer shell of the bonnet; to provide such a hair dryer in which an external audio cable is selectively connectable between the audio jack and any suitable source of audio information or entertainment; to provide such a hair dryer which allows a user to conveniently access audio entertainment and information while his or her hair is being dried; to provide such a hair dryer in which air deflectors in the bonnets are placed around the speakers to prevent heated air from being directed onto the speakers; to provide such a hair dryer in which the stereo audio system is virtually invisible when the external audio cable is removed; and to provide such a hair dryer which is attractive, reliable, economical to manufacture, and which is particularly well suited for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

I. Introduction and Environment

Figure 1:
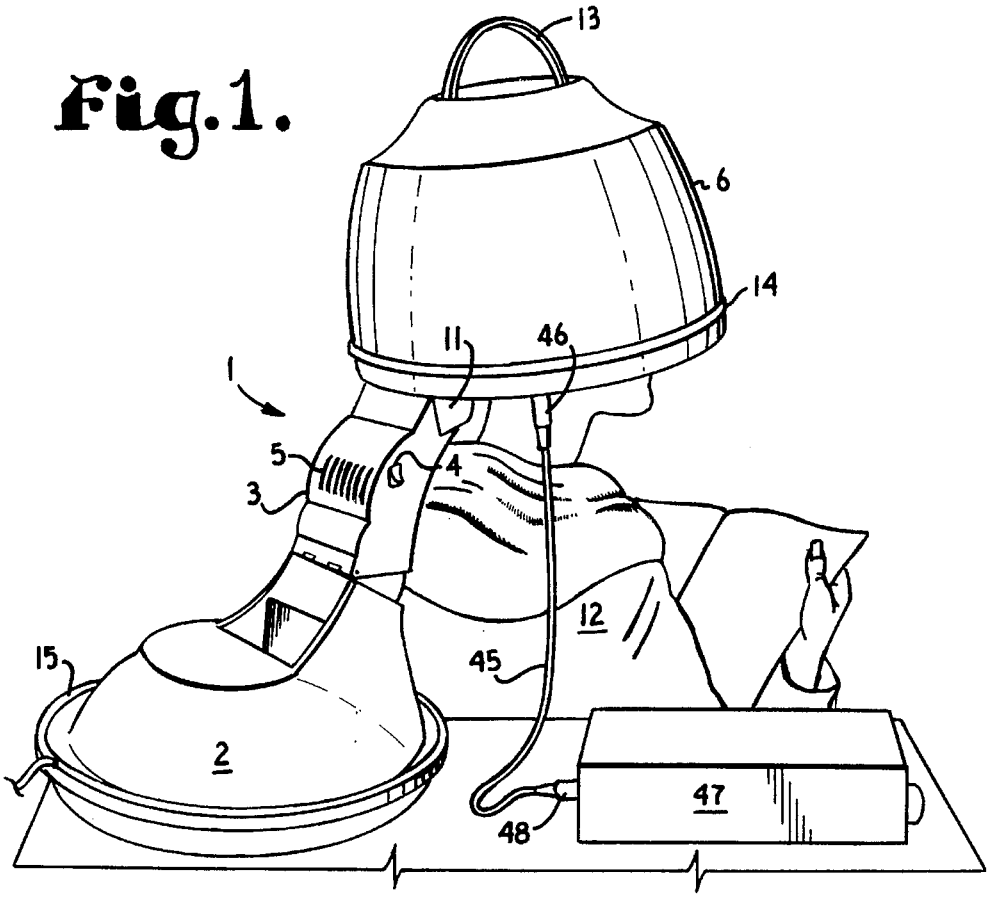
FIG. 1 is a perspective view of a rigid bonnet style hair dryer in accordance with the present invention, with the bonnet positioned on a user's head and with an external audio cable connected between an audio input jack in the bonnet and an audio source.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, the words "up", "down", "right" and "left" will refer to directions in the drawings to which reference is made. The words "inward" and "outward" will refer to directions toward and away from, respectively, the geometric center of the embodiment being described and designated parts thereof. The word "front" will refer to the forward or face side of a person or object having a denominated forward face or front side, while the word "back" will refer to the side of a person or object opposite the front side. Said terminology will include the words specifically mentioned, derivatives thereof, and words of a similar import.

II. Rigid Bonnet Hair Dryer

Referring to the drawings in more detail, FIG. 1 illustrates a rigid bonnet style hair dryer according to the present invention, generally designated as 1. The hair dryer 1 includes a base 2 within which is housed a heating element, motor and fan (not shown). The base 2 is hingedly connected to a lower end of a neck portion 3 within which an optional variable damper (not shown) can be positioned. A damper control 4 can be attached to control the damper position within the neck portion 3. With the optional variable damper and the damper control 4, drying air from the blower in the base 2 can be selectively diverted out of a louvered opening 5 or into a rigid hair drying bonnet 6. The rigid bonnet 6 is hingedly connected to the top end of the neck portion 3 by a hollow pivot connection 11 via which heated air is introduced into the rigid bonnet 6 in a conventional fashion. The rigid bonnet 6 is shown positioned over the head of a user 12. The rigid bonnet 6 also includes a carrying strap 13 attached to the top thereof, and the rigid bonnet 6 and the neck portion 3 can be selectively pivoted backward such that a sealing grommet 14 which encircles the rigid bonnet 6 rests on a rim 15 of the base 2 to close the hair dryer into a compact package for storage or transport.

III. Rigid Hair Dryer Bonnet and Stereo Audio System

Figure 2:
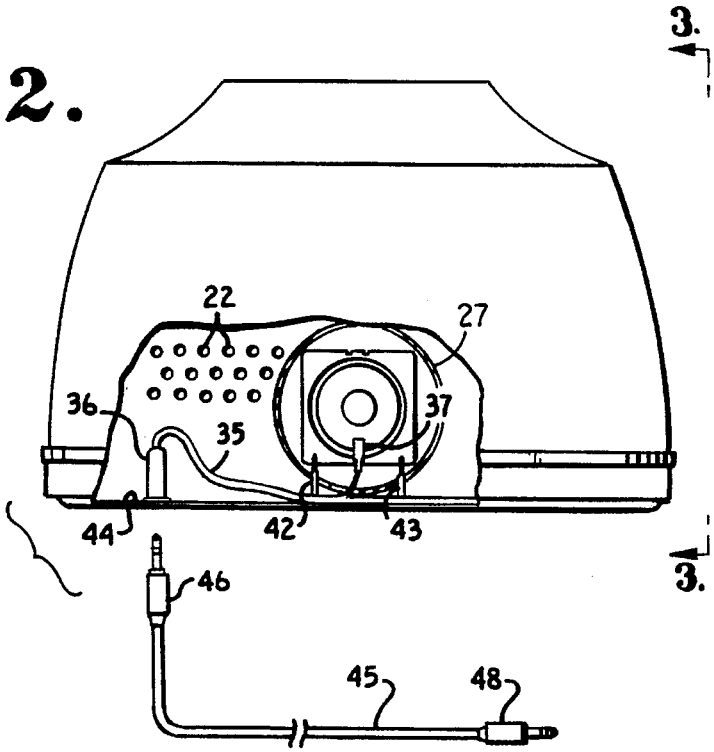
FIG. 2 is a side elevational view of the rigid hair dryer bonnet, with portions broken away to illustrate the mounting of a stereo speaker on one side of the bonnet and the position of an audio cable and input jack within the bonnet, and with the external audio cable positioned for connection to the audio input jack.
Figure 3:
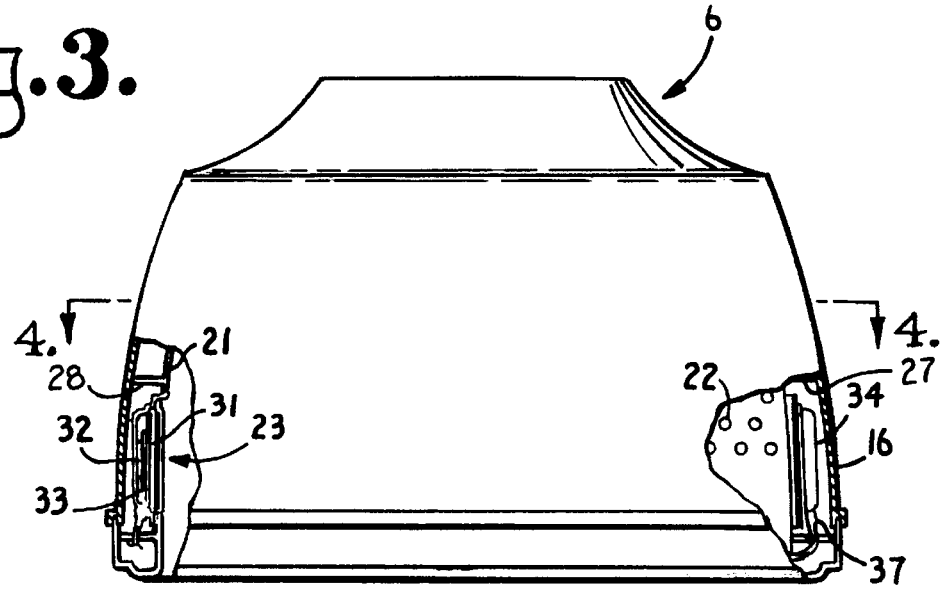
FIG. 3 is a front elevational view of the rigid hair dryer bonnet, with portions broken away to illustrate the mounting of stereo speakers on each side of the bonnet, and with one of the speakers shown in cross-section to illustrate the interior construction thereof.
Figure 4:
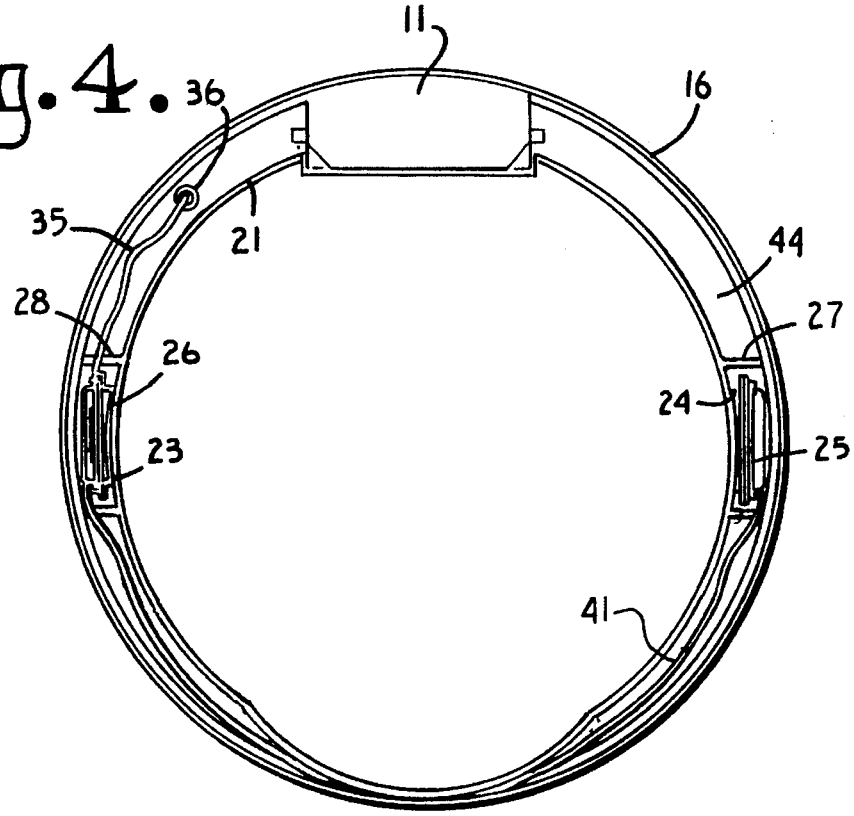
FIG. 4 is a cross-sectional view of the rigid hair dryer bonnet, taken along line 4—4 of FIG. 3, and illustrating the relative positions of the stereo speakers and the routing of an audio cable between the audio jack and the right speaker and between the speakers themselves.

Referring to FIGS. 2–4, the rigid bonnet 6 includes an outer shell 16 and an inner liner 21. The inner liner 21 is perforated with a plurality of air circulating apertures 22. Heated air is circulated between the outer shell 16 and the inner liner 21 and reaches the hair of the user 12 via the apertures 22.

The inner liner 21 includes right and left circular openings 23 and 24 which are positioned proximate the right and left ears, respectively, of the user 12. Left and right speakers 25 and 26, respectively, are positioned within the openings 24 and 23. Surrounding each of the speakers 25 and 26 are respective air deflectors 27 and 28. The deflectors 27 and 28 connect the outer shell 16 with the inner liner 21 peripherally around each of the speakers 25 and 26 to prevent heated air from being blown directly onto the speakers. This prevents the speakers 25 and 26 from being heated to a temperature which would make them uncomfortable in contact with the ears of the user 12, as well as extending the useful life of the speakers 25 and 26.

The speakers 25 and 26 are identical and thus only the right speaker 26 will be described in detail. The speaker 26, which is illustrated in cross section in FIGS. 3 and 4, includes a movable diaphragm 31 to which is attached a coil 32 positioned within a permanent magnet 33. An outer seal 34 encloses the diaphragm 31, coil 32 and magnet 33. The speakers 25 and 26 may be of the type which are employed in typical stereophonic headphone sets.

A three conductor stereo audio cable 35 is connected between a three conductor phone type audio input jack 36 and the right and left speakers 26 and 25. As is conventional in stereo audio cables, a right channel conductor and a common or ground conductor (not shown) in the cable 35 are connected to the movable coil 32 in the speaker 26 via clip-on terminals 37. A left channel conductor and ground conductor in the cable 35 extend, via a cable extension 41, around the periphery of the rigid bonnet 6 between the outer shell 16 and the inner liner 21 and connect to the left speaker 25 via clip-on terminals 37. Each of the speakers 25 and 26 is supported by a pair of supports 42 and 43 (FIG. 2) which connect to a continuous ledge 44 surrounding the interior base of the rigid bonnet 6 and in which the input jack 36 is mounted. Stereo audio signals are thus input through the jack 36 via the left and right channel and ground conductors in the cable 35 to respective ones of the speakers 25 and 26 such that the user 12 can conveniently listen to stereo or monaural audio information or entertainment while having her hair dried.

Referring to FIGS. 1 and 2, an external audio input cable 45 is shown connected at one end to the input jack 36 via a three conductor phone plug 46, and, in FIG. 1, at the opposite end to an audio source such as radio 47 via a three conductor phone plug 48.

The plugs 46 and 48 and jack 36 may be quarter inch phone type connectors, eighth inch type connectors, DIN connectors, or any other standard or commonly used type of audio connectors.

IV. Soft Hair Dryer Bonnet and Stereo Audio System

Figure 5:
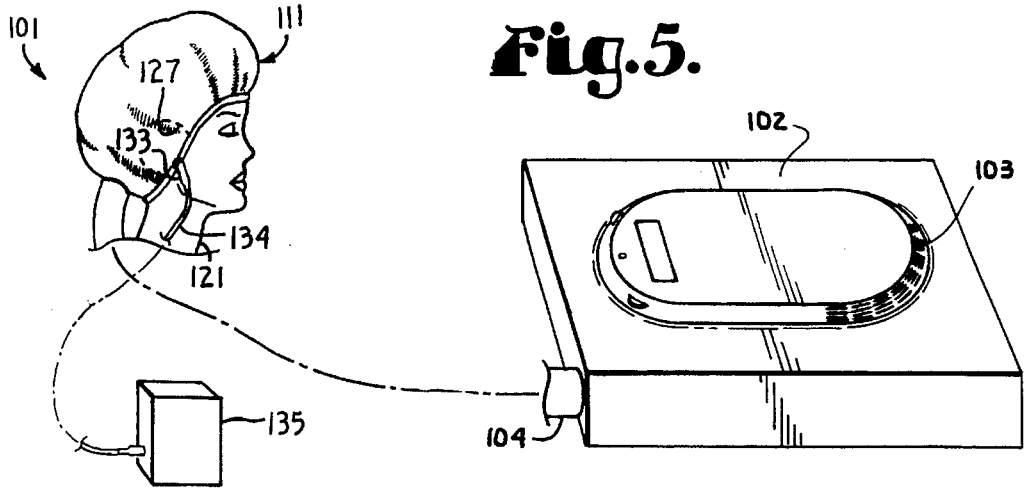
FIG. 5 is a perspective view of a soft bonnet style hair dryer in accordance with the present invention, with the bonnet positioned on a user's head and connected to a source of heated air via a flexible conduit and with an external audio cable connected between an audio input jack in the bonnet and an audio source.
Figure 6:
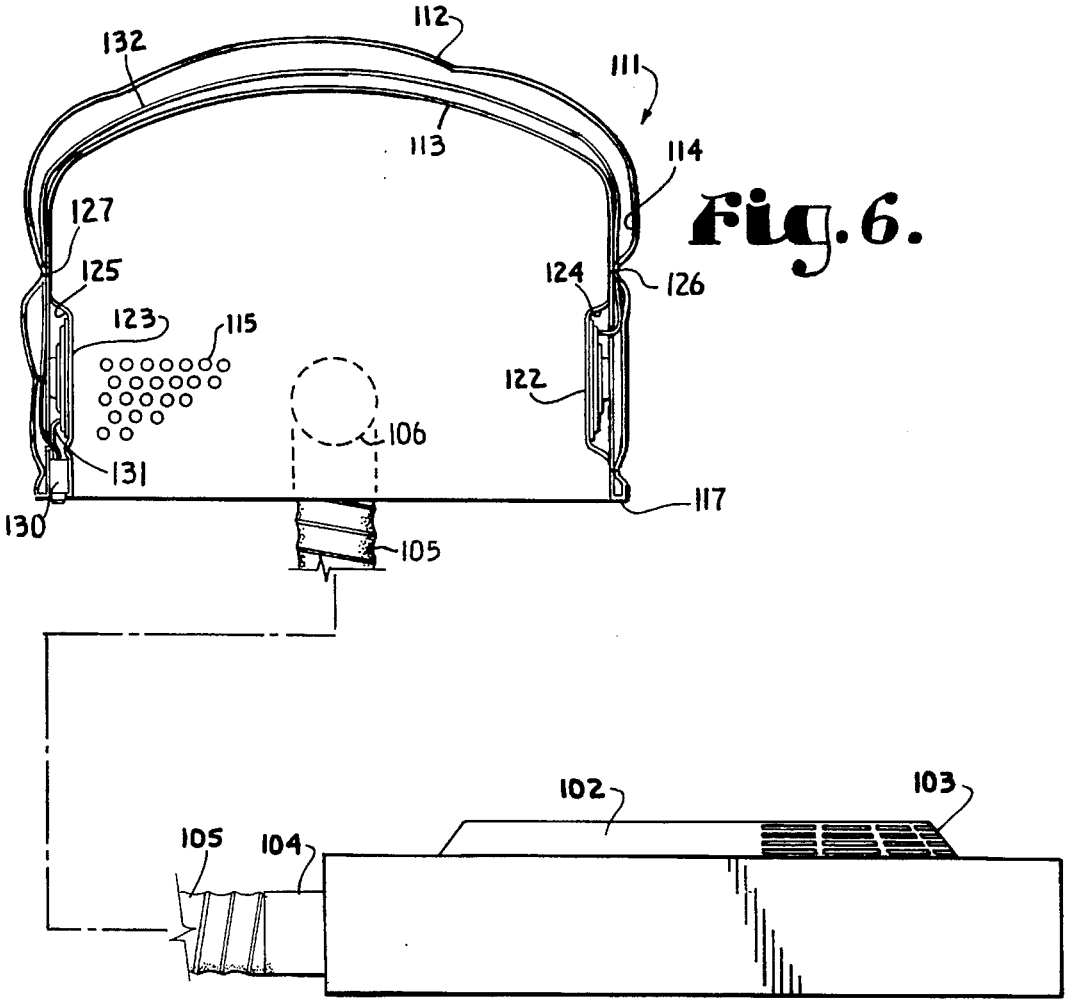
FIG. 6 is a side elevational view of the soft hair dryer bonnet, with portions broken away to illustrate the mounting of a stereo speaker on one side of the bonnet and the position of an audio cable and input jack within the bonnet.

Referring to FIGS. 5 and 6, an alternative, soft bonnet hair dryer, generally indicated as 101, is illustrated. The hair dryer 101 includes a base unit 102 incorporating a conventional heater, motor and fan (not shown) which heats air introduced through a grid 103 in the top of the base unit 102 and exhausts the heated air out an outlet 104. The outlet 104 of the base unit 102 is connected to one end of a flexible hose 105. A second end of the flexible hose 105 is connected to an air inlet 106 on a soft, flexible bonnet 111. The soft bonnet 111 includes an air impermeable flexible outer covering 112 and a flexible inner liner 113. The air inlet 106 opens into a space 114 between the outer covering 112 and the inner liner 113 to introduce heated air therein. As in the rigid bonnet 6, a number of apertures 115 are formed in the inner liner 113 such that heated air is blown through the apertures 115 and onto the hair of a user 121. A lower peripheral rim 117 of the bonnet 111 preferably has an elastic band (not shown) positioned therein to comfortably retain the bonnet 111 on the head of the user 121. The rim 117 fits somewhat loosely about the user's head to provide an outlet for the heated air and evaporated moisture.

As in the rigid bonnet 6, a pair of audio speakers 122 and 123 are attached to the soft bonnet 111 as an integral part thereof. The speakers 122 and 123, which have a structure similar to the speakers 23 and 24 in the rigid bonnet 6, are positioned within respective pockets 124 and 125 formed by flaps attached to the inner liner 113 of the bonnet 111. The speakers 122 and 123 are thus positioned in close proximity to the left and right ears, respectively, of the user 121 when the soft bonnet 111 is placed on her head. A pair of air deflecting seams 126 and 127, with the seam 127 shown in phantom lines in FIG. 5, are positioned around the speakers 122 and 123, respectively. As in the hard bonnet 6, the seams 126 and 127, which can be stitch lines or welds, for example, connect the outer covering 112 with the inner liner 113 peripherally around the speakers 122 and 123, respectively, to prevent heated air from being blown directly onto the speakers. This prevents the speakers 122 and 123 from being heated to a temperature which would make them uncomfortable in contact with the ears of the user 121. Furthermore, preventing heated air from reaching the speakers 122 and 123 extends the useful life of the speakers themselves.

As illustrated in FIG. 6, a three conductor phone jack 130 is attached to the inner liner 113 within the space 114 between the inner liner 113 and the outer covering 112. A short length of two conductor cable 131 is connected to a right channel terminal and the ground terminal (not shown) of the jack 130 at one end and to the right speaker 123 at the other end. A two conductor extension cable 132 is connected to a left channel terminal and a ground terminal (not shown) of the jack 130 and is threaded through the space 114 to the left speaker 122. For ease of viewing in the drawings, the extension cable 132 is shown, in FIG. 6, as threaded over the top of the inner lining 113, and thus over the top of the head of the user 121. It is understood that the extension cable 132 can also be threaded within the space 114 behind, and around the back of the head of the user 121 in a manner similar to that shown in FIG. 4 with respect to the threading of the cable extension 41. Indeed, the cable 132 can be threaded through the space 114 around the periphery of the soft bonnet 111 either in front of, or around the back of the head of the user 121. The audio jack 130 is positioned such that a stereo plug 133 from an audio cable 134 (FIG. 5) can be selectively plugged into the jack 130. The opposite end of the cable 134 is connected to a stereophonic source of audio, such as a radio 135 or the like.

While radios 47 and 135 are illustrated herein, it should be emphasized that the design of the inventive rigid bonnet 6 and the soft bonnet 111 allows the user 12 or 121 to be selectively connected to any suitable source of audio signals, including the radios 47 or 135, a television audio jack, CD or cassette player, computer lap top computer, video game or other audio source. At the same time, the fact that the input jacks 36 and 130 are entirely hidden within the interior of the rigid bonnet 6 and the soft bonnet 111, respectively, with the external cables 45 and 134 being removable, insures that, during times that the user 12 or 121 does not desire to listen to audio programming, the integral stereo system is virtually invisible from the exterior of the hair dryer 1 or 101. As an additional alternative, a radio or CD player or the like could be integrally incorporated into the base 2 or 102, with audio cabling routed to the bonnet 6 or 111 through an air flow passage, as defined by the neck portion 3 or the hose 105, respectively. The integral radio or CD player can also incorporate a jack for connection of an outside audio source through cabling of the radio or CD player.

It is to be understood that while certain forms of the present invention have been illustrated and described herein, it is not to be limited to the specific forms or arrangement of parts described and shown.

What is claimed and desired to be secured by Letters Patent is as follows:

1. A soft bonnet style hair dryer, comprising:

a. a collapsible soft bonnet sized to accommodate the head of a user, said bonnet comprising:

i. an outer shell which is relatively impervious to air; and ii. an inner liner which is perforated to allow the passage of air therethrough;

b. a hair dryer mechanism selectively communicating heated air to said bonnet between said outer shell and said inner liner;

c. a first and a second audio speaker integrally mounted within said soft bonnet, said first and second audio speakers being positioned between said outer shell and said inner liner and each including an air deflecting means which seals off the first speaker from heated air circulating between said outer shell and said inner liner, each of said air deflecting means including a seam connecting said outer shell to said inner liner, said first and second speakers being positioned such that they direct sound through said inner liner to respective ears of said user such than audio information can be conveyed to the user while his or her hair is being dried;

d. an audio connector mounted on said bonnet; and e. audio cabling connecting said audio connector to said first and second speakers in a stereophonic relationship, at least a portion of said cabling positioned between said outer shell covering and said inner liner.

2. A hair dryer as in claim 1, and further comprising:

a. said audio connector comprising an audio input jack mounted on said bonnet.

3. A dryer as in claim 2, and further comprising:

a. an external audio cable selectively connectable between said audio input jack and an audio signal source.

4. A bonnet style hair dryer as in claim 3, wherein said external audio cable is removable from said audio input jack.

5. A soft, flexible hair dryer bonnet which is expandable to universally accommodate the head of a user, said bonnet being adapted to receive heated air from a hair dryer mechanism and said bonnet comprising:

a. a flexible outer shell covering which is relatively impervious to air;

b. a flexible inner liner which is perforated to allow the passage of air from between said outer shell and inner liner to the user's head therethrough;

c. a first audio speaker attached to said inner liner within said bonnet;

d. a second audio speaker attached to said inner liner within said bonnet;

e. each of said first and second speakers being positioned between said outer shell and said inner liner and each including an air deflecting means which seals off the respective speaker from air circulating between said outer shell and said inner liner, each of said air deflecting means including a seam connecting said outer shell covering to said inner liner, said first speaker being positioned such that it directs sound through said inner liner to one ear of said user and said second speaker being positioned such that it directs sound through said inner liner to the opposite ear of said user;

f. an audio connector mounted on said bonnet; and g. audio cabling connecting said audio connector to said first and second speakers in a stereophonic relationship, at least a portion of said cabling positioned between said outer shell covering and said inner liner.

6. A hair dryer as in claim 5, and further comprising:

A. said audio connector including an audio input jack positioned within said outer covering with an opening extending through said outer covering.

7. A bonnet as in claim 6, and further comprising:

a. a removable external audio cable selectively connectable between said audio input jack and an audio signal source.

* * * * *